US007048137B2

(12) United States Patent
Leoncavallo et al.

(10) Patent No.: US 7,048,137 B2
(45) Date of Patent: May 23, 2006

(54) DRINKING CONTAINER WITH MULTILAYER LEAK-PROOF CLOSURE

(75) Inventors: Richard A. Leoncavallo, Niagara Falls, NY (US); John D. DeLorme, Spencerport, NY (US)

(73) Assignee: Nalge Nunc International Corporation, Rochester, NY (US)

( * ) Notice: Subject to any disclaimer, the term of this patent is extended or adjusted under 35 U.S.C. 154(b) by 195 days.

(21) Appl. No.: 10/632,288

(22) Filed: Aug. 1, 2003

(65) Prior Publication Data

US 2005/0115966 A1 Jun. 2, 2005

(51) Int. Cl.
*B65D 41/04* (2006.01)

(52) U.S. Cl. ..... 220/288; 215/347

(58) Field of Classification Search ..... 220/212.5, 220/288, 304, 626; 215/DIG. 2, 347, 399, 215/DIG. 4, 334, 341; D9/443; 264/255, 264/328.8

See application file for complete search history.

(56) References Cited

U.S. PATENT DOCUMENTS

| | | | | |
|---|---|---|---|---|
| D39,476 | S | 9/1908 | Bagby | |
| D133,132 | S | 7/1942 | Nesset | |
| D138,925 | S | 9/1944 | Ostrin et al. | D83/8 |
| D177,570 | S | 5/1956 | James | D58/25 |
| D181,462 | S | 11/1957 | Chapman | D58/8 |
| D190,204 | S | 4/1961 | Muller et al. | |
| D208,731 | S | 9/1967 | Reintsema | |
| D210,067 | S | 2/1968 | Abe | |
| D217,758 | S | 6/1970 | Schweickart | D9/1 |
| D234,911 | S | 4/1975 | Stevens, Jr. | |
| D235,032 | S | 4/1975 | Atkins | |
| D261,991 | S | 11/1981 | Schroeder | |
| D262,437 | S | 12/1981 | Gutkowski | |
| D272,723 | S | 2/1984 | Baker | |
| 4,440,820 | A * | 4/1984 | Shiho et al. | 428/120 |
| 4,475,661 | A * | 10/1984 | Griffin | 215/366 |
| 4,489,844 | A * | 12/1984 | Breskin | 215/329 |
| 4,694,969 | A | 9/1987 | Granat | |
| 4,729,488 | A | 3/1988 | Bullock, III | |
| 4,756,437 | A * | 7/1988 | Rossi-Mossuti | 215/230 |
| 4,838,464 | A | 6/1989 | Briggs | |
| D311,139 | S | 10/1990 | Butler | |
| D315,095 | S | 3/1991 | Wright | |
| 4,998,989 | A * | 3/1991 | Curiel | 215/250 |
| D316,184 | S | 4/1991 | Mikkelsen | |
| 5,054,154 | A | 10/1991 | Schiffer et al. | |
| D329,980 | S | 10/1992 | Powell et al. | |
| D332,379 | S | 1/1993 | Murphy | |
| D337,274 | S | 7/1993 | Thatcher | D9/539 |
| 5,255,805 | A | 10/1993 | Weiss et al. | |
| D343,793 | S | 2/1994 | Crawford | |
| 5,287,982 | A | 2/1994 | Tsai | |
| 5,339,482 | A | 8/1994 | Desimone et al. | |
| 5,358,129 | A | 10/1994 | Watts et al. | |
| D355,022 | S | 1/1995 | Canther | |

(Continued)

*Primary Examiner*—Lien M. Ngo
(74) *Attorney, Agent, or Firm*—Wood Herron & Evans, LLP

(57) ABSTRACT

A drinking container comprises a bottle and a permanently leak-proof closure. The bottle is formed with contours that facilitate grasping by a user and has an opening sized to facilitate placing ice cubes into the bottle. Graduations on the sidewall of the bottle provide an indication of the volume of fluid within the bottle. The closure has threads configured to engage corresponding threads on the bottle and has a seal ring for sealing the liquid contents within the bottle. The closure further includes a lobe having an aperture.

9 Claims, 4 Drawing Sheets

U.S. PATENT DOCUMENTS 5,409,151 A 4/1995 Freimark
5,423,419 A 6/1995 Wentz et al.
5,439,124 A * 8/1995 Mock ..... 215/40
5,454,476 A 10/1995 King et al.
5,530,989 A 7/1996 Remmert et al.
5,562,928 A * 10/1996 Ando et al. ..... 425/130
5,579,932 A 12/1996 Drozd et al.
D377,435 S 1/1997 Dettmar et al. ..... D7/300
D389,064 S 1/1998 Sethi et al. ..... D9/521
D389,740 S 1/1998 Toleman
5,711,465 A 1/1998 Pittarelli et al.
5,735,417 A 4/1998 Darr et al.
5,803,281 A 9/1998 Towns
D407,210 S 3/1999 Lauth, III
5,938,053 A * 8/1999 Verbovszky et al. ..... 215/6
5,992,656 A 11/1999 Dujardin et al.
D422,113 S 3/2000 Higgins et al. ..... D27/186
6,039,207 A 3/2000 Adameck
D422,503 S 4/2000 Lehn
D422,916 S 4/2000 Herrmann
D425,796 S 5/2000 Duranthon ..... D9/540
D429,152 S 8/2000 Lane
6,095,359 A * 8/2000 Richmond ..... 215/341
D433,532 S 11/2000 Higgins et al. ..... D27/186
D437,229 S 2/2001 Andrew
6,202,869 B1 3/2001 Sullivan
D445,692 S 7/2001 Meeker et al.
D447,410 S 9/2001 Malmborg
D448,672 S 10/2001 Cheng et al.
6,305,563 B1 * 10/2001 Elliott ..... 215/235
D454,066 S 3/2002 Trabal
D457,439 S 5/2002 Meeker et al. ..... D9/537
D458,133 S 6/2002 Berish et al.
D458,134 S 6/2002 Berish et al.
D462,618 S 9/2002 Meeker et al. ..... D9/530
6,481,589 B1 * 11/2002 Blomdahl et al. ..... 215/303
D473,142 S 4/2003 Beaver
D479,800 S 9/2003 McRae ..... D9/443
D481,938 S 11/2003 McRae ..... D9/332
D482,607 S 11/2003 McRae ..... D9/313
D485,757 S * 1/2004 Roth et al. ..... D9/443
D508,185 S 8/2005 Gauss ..... D7/392.1
2002/0084241 A1 7/2002 Yu-Hsien

* cited by examiner

DRINKING CONTAINER WITH MULTILAYER LEAK-PROOF CLOSURE

FIELD OF THE INVENTION

The present invention pertains to containers for storing and dispensing liquid materials, and more particularly to a drinking bottle having a multilayer leak-proof closure.

BACKGROUND OF THE INVENTION

Various types of bottles have been used to permit persons to carry water or other liquids for drinking. In particular, such bottles are typically used by persons involved in sports, or other physical activities, to provide a ready supply of liquid whereby the users may be kept hydrated during performance of these activities. Desirable features of such bottles include:

sufficient durability to withstand repeated use and automatic dishwasher conditions;

features that permit users to view the contents of the bottle to thereby ascertain the type of liquid or volume of liquid in the bottle;

features that permit the bottle to be sealed tightly, in a permanent leak-proof manner, and to easily re-open the bottle when it is desired to consume the liquid;

features that allow users to carry the bottle, on their person or secured to carried articles, without interfering with activities performed by the user;

features that permit users to maintain liquids stored in the bottle at chilled temperatures; and features that make drinking directly from the bottle easy and comfortable.

While many different types of drinking containers are available, conventional drinking containers do not generally incorporate all, or selected groups of the features described above. For example, bottles which are opaque do not provide a visual indication of the quantity or type of liquid which is contained in the bottle and do not permit users to measure the volume of liquid contained within the bottle. The ability to measure the volume of liquid in a bottle is helpful when the user desires to mix ingredients in the liquid to be consumed (such as in a "power drink") or when it is desired to keep track of the volume of liquid consumed. On the other hand, many transparent, disposable bottles are not sufficiently durable to accommodate repeated use. Likewise, with a durable bottle designed to last for years, maintenance of a permanently leak-proof seal must be achieved without the use of rubber or silicone sealing gaskets that tend to harbor molds and deteriorate with time.

Many users prefer chilled drinks, but it is typically difficult to maintain liquid stored in conventional bottles at cool temperatures during activities such as hiking, cycling, or other activities where the bottle must be carried by the user, or in instances where the user is away from a cooler or refrigerator. To exacerbate the problem, many conventional water bottles do not have a sufficiently large opening to make placing ice cubes in the bottle easy. Accordingly, users must either break up the ice prior to placing it in the bottle or freeze the contents of the bottle. Freezing the contents of the bottle is disadvantageous because the user cannot consume the liquid until the frozen contents have melted.

Another drawback of conventional drinking bottles which utilize screw caps is that the threaded neck of the bottle interferes with the lips of the user, making drinking directly from the bottle uncomfortable or difficult. Yet another drawback of many conventional drinking bottles is that they are not generally provided with features which facilitate carrying the bottle by a user without interfering with the activity being performed.

There is thus a need for an improved drinking bottle which overcomes drawbacks of the prior art, such as those described above.

SUMMARY OF THE INVENTION

The present invention provides a drinking container which may be carried by a user to ensure ready access to liquids, for example, during the performance of physical activities. The container comprises a bottle and a closure which have features that facilitate carrying the container and consuming liquids therefrom. In one aspect of the invention, the bottle and closure have corresponding screw threads so that the closure may be readily secured to the bottle to seal the liquid contents therein. Likewise, the closure may be readily removed from the bottle when it is desired to consume the liquid contents. Advantageously, the uppermost thread on the bottle is spaced from an upper edge of the bottle's neck leaving the uppermost neck section unthreaded to permit users to drink directly from the bottle without interference from the threads.

The closure includes a lobe that extends upwardly from the top surface of the closure. Advantageously, the lobe facilitates grasping the closure to make opening and closing the container easier. An aperture formed through the lobe provides a convenient feature for suspending the container, for example, from a clip or strap that may be worn by a user or secured to an article, such as a backpack, that is in turn carried by the user.

In another aspect of the invention, an opening at the neck of the bottle is sized to be sufficiently narrow to permit users to drink easily from the bottle, while also being sufficiently wide to permit users to easily place ice cubes within the bottle. The size of the opening represents a balance between these two desirable functions of the bottle.

In yet another aspect of the invention, the closure is formed from at least two polymeric materials. The first polymeric material, which comprises a core of the closure, is selected to provide structural rigidity to the closure and preserve the integrity of the seal ring by avoiding variations in wall thickness in that area of the closure. The second polymeric material, which comprises an outer layer of the closure, is selected to provide an aesthetically pleasing feel to the closure. For example, the second material may be selected to provide a soft feel, or to provide a textured feel which helps users grip the closure, as may be desired.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 4:
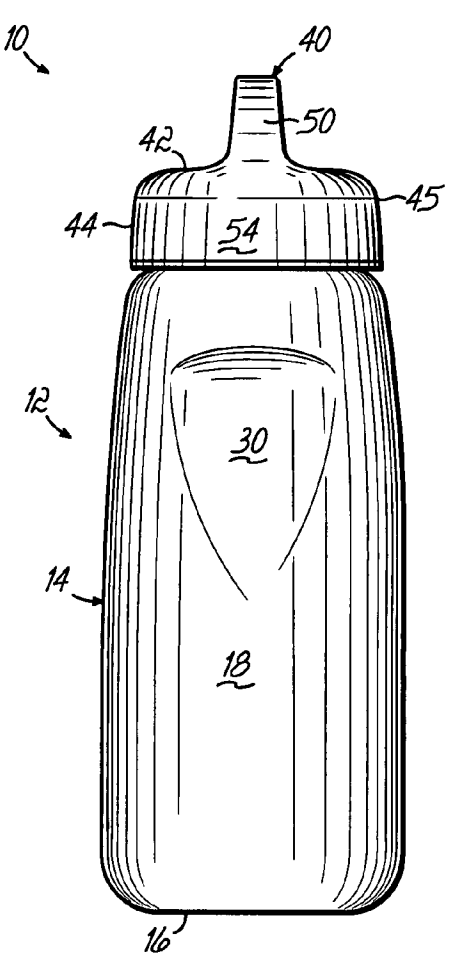
FIG. 4 is an elevational view of the drinking container of FIG. 2, viewed along line 4—4.
Figure 2:
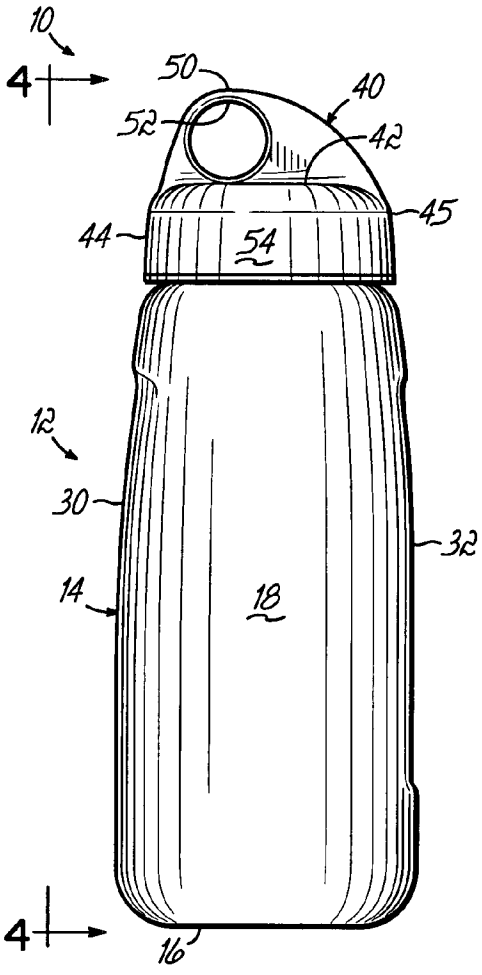
FIG. 2 is a side elevational view of the drinking container of FIG. 1.

Referring to FIGS. 1–5, there is shown an exemplary liquid container 10 according to the present invention. The container 10 includes a bottle 12 comprising a bottle body 14 having a base 16 and an upwardly extending sidewall 18 defining an interior reservoir 20 (FIG. 3) for receiving and storing liquids. The bottle 12 further includes a neck portion 22 opposite the base 16 and having a top edge 24 defining an opening 26 into the reservoir 20 of the bottle 12. In the exemplary embodiment shown, the bottle body 14 has a generally cylindrical shape.

To further facilitate grasping of the bottle 12, the sidewall 18 of the bottle includes contours 30, 32 which are shaped to provide an ergonomic fit with a user's hand. A first contour 30 (seen most clearly in FIG. 4) is formed into a circumferential portion of the sidewall 18 at an upper end of the bottle 12 and is configured to provide an engagement surface for the thumb of a user's hand. In the exemplary embodiment shown, the first contour 30 has a generally triangular shape, wherein the contour 30 is wider toward the upper end of bottle 12 and gradually narrows in a direction toward base 16. A second contour 32 is formed into the bottle 12, generally opposite the first contour 30, and extends in an axial direction along the sidewall 18 to provide a form fit for the fingers of a user's hand.

In an exemplary embodiment, the bottle 12 is formed by injection blow molding, wherein hot polymeric material is injected in to a mold cavity at a first station to create a blank. The blank is then transferred to a second station where it is blown up into the finished bottle 12. The exemplary bottle 12 shown has an overall height of approximately 203 mm, an outer diameter of approximately 86.5 mm, and a wall thickness of approximately 1.5 mm. The bottle 12 is sized to accommodate approximately 750 ml of liquid. It will be recognized, however, that the bottle 12 may be produced in other sizes to accommodate other volumes, as may be desired.

Figure 1:
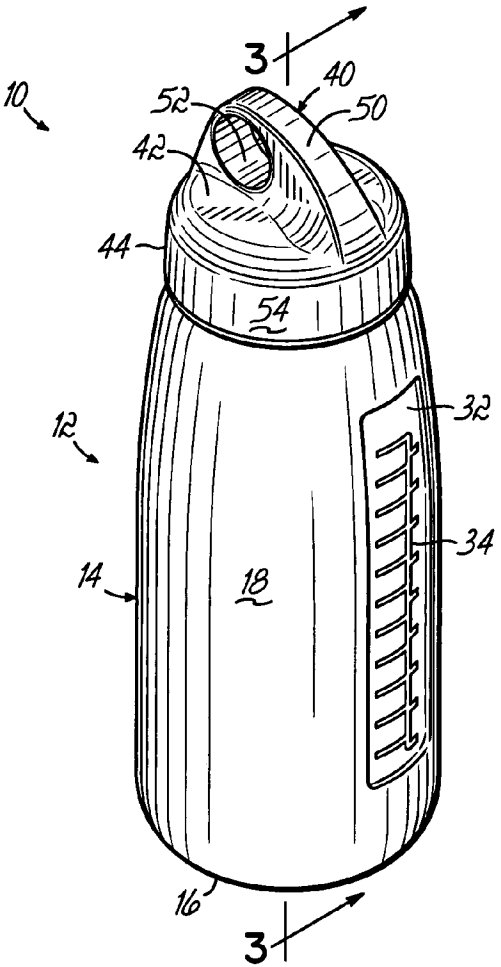
FIG. 1 is a perspective view of an exemplary drinking container according to the present invention.

In the exemplary embodiment shown, the bottle 12 further includes graduated markings 34 formed into the sidewall 18, as best depicted in FIG. 1. While not shown, the markings may include indicia such as numbers or letters. Advantageously, when the bottle body 14 is formed from a transparent or semitransparent material, the graduated markings 34 may be used to determine the volume of liquid in the bottle reservoir 20. In the exemplary embodiment shown, the graduated markings 34 are formed as raised features on the sidewall 18, however, it will be recognized that the graduated markings 34 may alternatively be embossed into sidewall 18, formed as printed characters, or formed in other ways to provide a visible indication of liquid volume. Furthermore, while the graduated markings 34 are shown formed in the area of the second contour 32, it will be recognized that the graduated markings 34 may alternatively be positioned on other locations of the sidewall 18.

The bottle 12 further includes external screw threads 36 disposed on the neck portion 22 for engagement with corresponding threads of a closure for the bottle 12. In the exemplary embodiment shown, the uppermost thread 36*a* is spaced a distance from the top edge 24 of the neck 22. Advantageously, the location of the uppermost thread 36*a* provides an unthreaded portion 38 on the neck 22 which facilitates drinking of the contents of the container 10 by a user. Specifically, the unthreaded portion 38 of the neck 22 provides a comfortable interface with the lips of a user whereby a user may engage their lips against the neck 22 without interference from the threads 36 on the bottle 12. To permit uses to drink comfortably from the bottle 12, the threads 36 should be spaced approximately 3 mm to approximately 25 mm below the top edge 24 of neck 22. In an exemplary embodiment, the uppermost thread 36*a* is spaced at least approximately 6 mm below the top edge 24 of the neck 22.

In another exemplary embodiment, the bottle 12 is formed from polycarbonate material to provide a durable and reusable bottle 12 for storing liquids to be consumed, for example, during activities such as biking, hiking, or other physical activities. Moreover, polycarbonate stands up to repeated washings in automatic dishwashers. The polycarbonate material may be provided in many colors for an aesthetically pleasing appearance and is transparent, or at least semitransparent, so that users may view the contents of the bottle 12 to determine the quantity or type of liquid stored therein. Alternatively, other moldable materials, including but not limited to polypropylene, acrylic, polystyrene, polycarbonate alloys, polycarbonate plus polyester, etc. are acceptable.

The opening 26 at the top edge 24 of the neck 22 of the bottle 12 is sized to facilitate consuming liquids directly from the bottle 12, while also permitting ice cubes or large chunks of ice to be placed easily into the reservoir 20 for chilling the liquid therein. Advantageously, the size of the opening 26 is selected to provide a balance between a large opening which easily admits ice into the reservoir 20, and a smaller opening which permits users to consume the liquid contents from the bottle 12 without spilling the liquid. In one embodiment, the opening 26 of the bottle 12 is between approximately 33 mm to 63 mm in diameter. In the exemplary embodiment shown, the opening 26 of the bottle 12 is approximately 53 mm in diameter.

Figure 3:
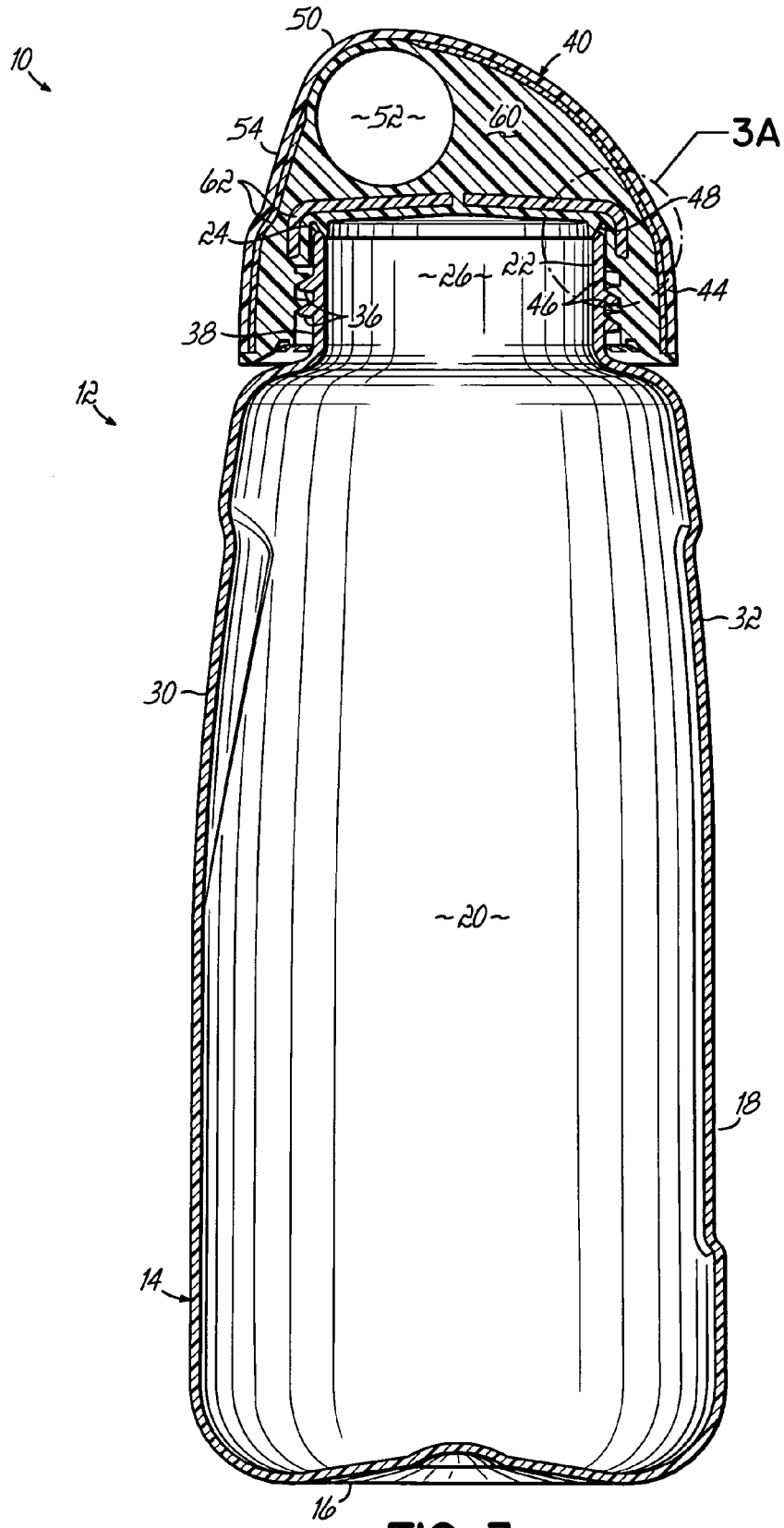
FIG. 3 is a cross-sectional view of the drinking container of FIG. 1, taken along line 3—3.
Figure 3A:
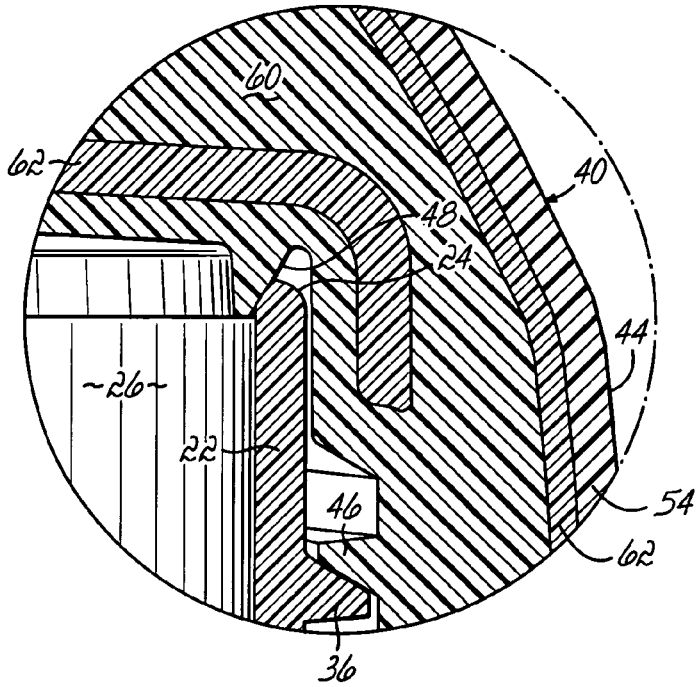
FIG. 3A is an enlarged detail of the encircled area of FIG. 3.

With continued reference to FIGS. 1–5, the liquid container 10 of the present invention further includes a closure 40 configured to be removably received on the bottle 12 to thereby seal the liquid contents within the bottle reservoir 20. In the exemplary embodiment shown, the closure 40 is configured to be received over the neck 22 of the bottle 12 to seal the opening 26. The closure 40 includes a generally circular-shaped end wall 42, and at least one sidewall 44 extending generally perpendicularly from the peripheral edge 45 of the end wall 42. As shown in FIG. 3, an interior surface of the sidewall 44 includes internal screw threads 46 configured to engage the corresponding external threads 36 on the bottle neck 22 whereby the closure 40 may be secured to the bottle 12 by screwing the closure 40 onto the neck 22 of the bottle 12. A seal ring 48 formed into an interior side of the end wall 42 is configured to engage the top edge 24 of the neck 22 to thereby seal in a water-tight, leak-proof manner, the opening 26 of the bottle 12, as illustrated most clearly in FIG. 3A. Alternatively, the seal may be made from a separate, compliant material such as that typically used in gaskets and o-rings, and known to those in the art.

The closure 40 further includes a lobe 50 extending upwardly from the end wall 42, in a direction opposite the sidewall 44 of the closure 40. Advantageously, the lobe 50 may be grasped by a user to facilitate securely tightening, and subsequently loosening the closure 40 from the bottle 12. An aperture 52 is formed through the lobe 50 and facilitates carrying the bottle 12, for example, by inserting a finger through the aperture 52. Alternatively, the bottle 12 may be secured to a clip, a hook, strap, or other attaching device (not shown) to be worn by a user. In the exemplary embodiment shown, the aperture 52 is offset from the center of the closure 40 toward the peripheral edge 45 of the closure 40.

In another exemplary embodiment, the closure 40 of the present invention is formed from at least two polymeric materials, whereby the first polymeric material forms an inner core of the closure 40 to provide structural rigidity to the closure 4. The second one of the polymeric materials forms an outer layer over the first polymeric material and optionally provides a soft "skin" to the closure 40 for a pleasing aesthetic feel. For example, the first, inner polymeric material may be formed with a material having a durometer that is greater than the durometer of the second material.

Figure 6:
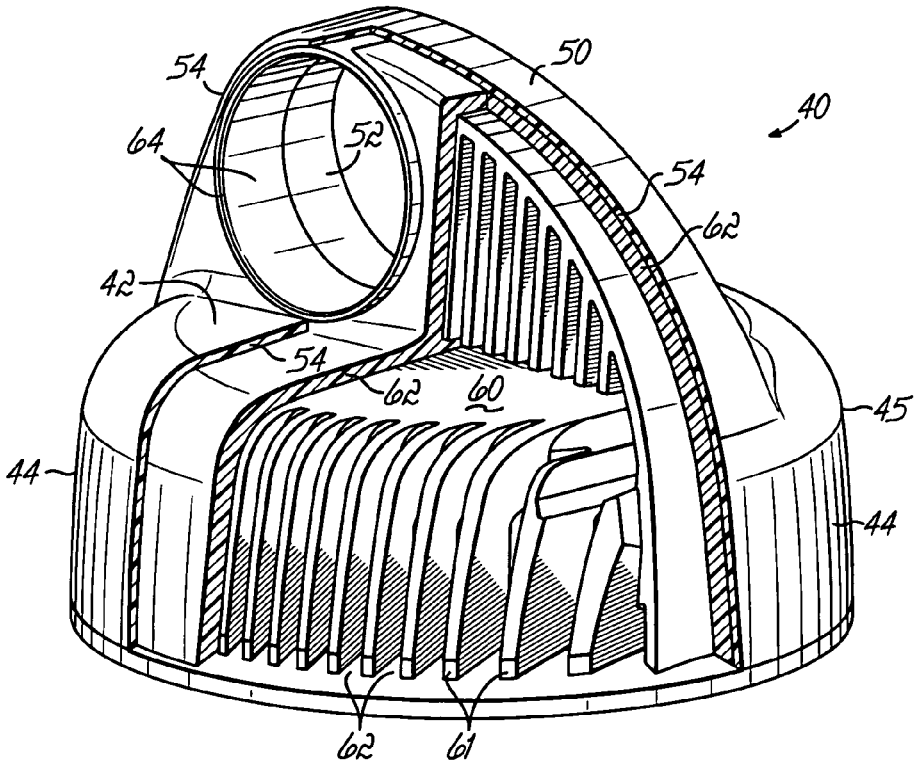
FIG. 6 is a perspective view of the closure of FIG. 5, with broken sections illustrating detail of the closure.
Figure 5:
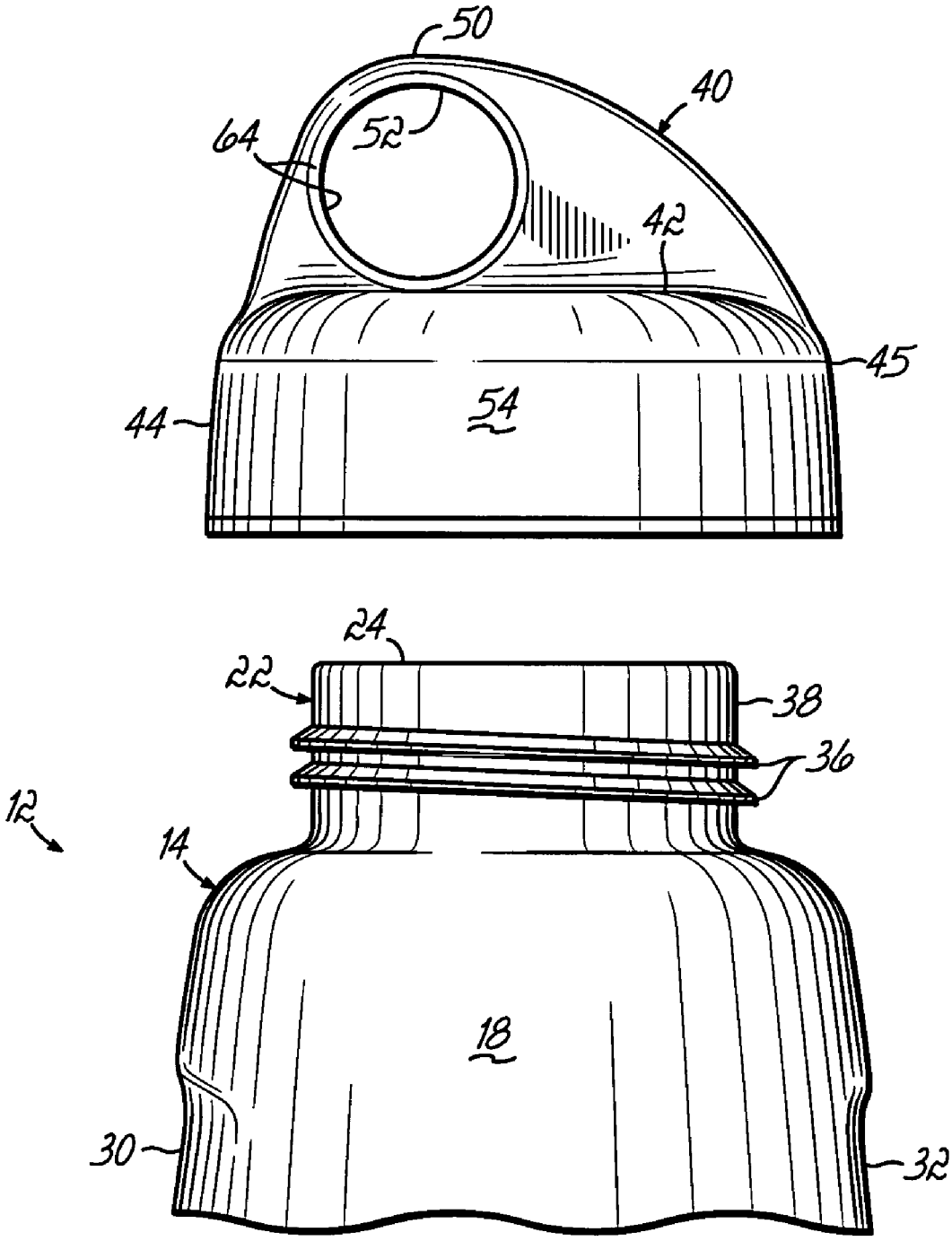
FIG. 5 is an exploded view of the container of FIG. 2, depicting the neck and closure of the container.

The development of a permanently leak-proof seal without a sealing gasket, using a multilayer closure of varying thickness throughout its design, presents a challenge that is overcome through a modification of molding procedures. The preferred method is to use a three-shot system wherein plastic material is injected at a first molding station to form the seal ring 48 and core 60 of the closure 40. Referring to the exemplary embodiment shown in FIGS. 3, 3A, and 6, the core 60 is formed to include a series of ribs 61 and intervening voids 63. The core 60 defines the general shape of the closure 40 and serves to form the seal ring 48. The ribs 61 and voids 63 in the core 60 provide desired variations in the thickness of the closure 40 and allow the subsequent material or materials to be added in uniform layers. Advantageously, the addition of uniform layers provides dimensional stability during the molding process, and since the seal ring is formed from the first layer, a leak-proof seal is achieved and is not compromised by additional layers.

At a second molding station, the voids 63 are filled in and the smooth shape of the closure 40 is accomplished by formation of the intermediate layer or shell 62. The outer surface material 54 is added in a uniform layer at a third molding station. A thin layer of third material is feasible because the first two layers substantially establish the shape of closure 40. Therefore, a more expensive material may be used for the third layer without significant increase to the overall cost of the closure 40. Alternatively, the number of stations and layers may be reduced to two, with the core 60 formed as described and the next layer serving to finish the closure 40.

The closure 40 may also be formed such that selected portions of the closure 40 are substantially free from the outer polymeric material. By substantially free, it is contemplated that, while it may be desired that a specific area be completely free of the outer polymeric material, typical manufacturing process and tolerances may cause a small amount of material to remain in that specific area. Such a small amount of material will generally not interfere with the function or appearance of the specific area which is to be free of the third material. In the exemplary embodiment shown in FIGS. 5 and 6, the closure has been formed such that an area 64 of the closure 40 encircling the aperture 52 formed through the lobe 50, including the inner diameter of aperture 52, is free from the outer layer of polymeric material.

In another exemplary embodiment, the closure 40 of the present invention is formed in three steps wherein the first material is a polypropylene copolymer, the second material is polypropylene and the outer polymeric material is thermoplastic elastomer. Alternatively, other materials, such as rubber or a blend of rubber and thermoplastic elastomer, as known to the art, are suitable to achieve a "soft-to-the-touch" outer layer. Other materials with characteristics suitable for other purposes may be substituted.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A closure for a bottle, comprising:

an end wall having a peripheral edge and an interior side;

at least one sidewall extending generally perpendicularly from said end wall and circumscribing said peripheral edge;

a seal ring formed on said interior side of said end wall;

a lobe formed on said end wall and extending in a direction opposite said sidewall and generally perpendicular to said end wall; and an aperture through said lobe;

said closure formed from at least two polymeric materials, whereby said first polymeric material forms a core of the closure, wherein said core is formed with a number of ribs and intervening voids to provide the closure with areas of varying thickness, and wherein said core forms said seal ring; and said second polymeric material layers over at least a portion of said first polymeric material and fills in said voids in said core, wherein said first polymeric material has a durometer greater than said second polymeric material.

2. The closure of claim 1, wherein said first polymeric material is polypropylene.

3. The closure of claim 1, wherein said second polymeric material is either polypropylene or thermoplastic elastomer.

4. The closure of claims 1, wherein said closure is formed such that said second polymeric material substantially covers said first polymeric material.

5. The closure of claim 4, wherein an area proximate said aperture is substantially free from said second polymeric material.

6. The closure of claim 1, further comprising internal screw threads disposed on side sidewall.

7. The closure of claim 1, wherein said aperture is offset from the center of said closure, toward said peripheral edge of said endwall.

8. A closure for a bottle, comprising:

an end wall having a peripheral edge and an interior side;

at least one sidewall extending generally perpendicularly from said end wall and circumscribing said peripheral edge;

a seal ring disposed on said interior side of said end wall;

a lobe disposed on said end wall and extending in a direction opposite said sidewall and generally perpendicular to said end wall; and an aperture through said lobe;

wherein said closure is formed from three polymeric materials, said first polymeric material forming a core of said closure, said second polymeric material forming an intermediate layer of said closure, and said third polymeric material forming an outer layer of said closure, wherein said core of said first polymeric material is formed with a number of ribs and intervening voids to provide said core with areas of varying thickness, and said second polymeric material fills in said voids and forms said intermediate layer.

9. The closure of claim 8, wherein said first, second, and third polymeric materials are polypropylene copolymer, polypropylene, and thermoplastic elastomer, respectively.

* * * * *

UNITED STATES PATENT AND TRADEMARK OFFICE

CERTIFICATE OF CORRECTION

PATENT NO. : 7,048,137 B2
APPLICATION NO. : 10/632288
DATED : May 23, 2006
INVENTOR(S) : Leoncavallo et al.

It is certified that error appears in the above-identified patent and that said Letters Patent is hereby corrected as shown below:

Column 4
Line 6, reads "...permit uses to drink comfortably from..." and should read --...permit users to drink comfortably from... --.

Column 5
Line 10, reads ""...the closure 4." and should read -- ...The closure 40. --.

Column 6
Line 41, reads "The closure of claims 1, wherein..." and should read -- The closure of claim 1, wherein... --.

Line 48, reads "..."...screw threads disposed on side sidewall." and should read -- ...screw threads disposed on said sidewall. --.

Signed and Sealed this

Nineteenth Day of September, 2006

JON W. DUDAS
*Director of the United States Patent and Trademark Office*